US006062435A

United States Patent [19]

Hess, III

[11] Patent Number: 6,062,435

[45] Date of Patent: May 16, 2000

[54] VALVED DISPENSING SYSTEM WITH PRIMING LIQUID LOSS PREVENTION

[75] Inventor: John M. Hess, III, Midland, Mich.

[73] Assignee: Aptargroup, Inc., Crystal Lake, Ill.

[21] Appl. No.: 09/306,325

[22] Filed: May 6, 1999

[51] Int. Cl.[7] ..... B67D 5/64

[52] U.S. Cl. ..... 222/175; 222/529; 222/547

[58] Field of Search ..... 222/175, 566, 222/547, 564, 529, 527

[56] References Cited

U.S. PATENT DOCUMENTS

| | | | |
|---|---|---|---|
| 4,061,254 | 12/1977 | Nilson . | |
| 4,226,342 | 10/1980 | Laauwe . | |
| 4,230,240 | 10/1980 | Laauwe . | |
| 4,747,518 | 5/1988 | Laauwe . | |
| 4,991,745 | 2/1991 | Brown . | |
| 5,012,956 | 5/1991 | Stoody . | |
| 5,115,950 | 5/1992 | Rohr . | |
| 5,226,568 | 7/1993 | Newton et al. . | |
| 5,271,531 | 12/1993 | Rohr et al. . | |
| 5,472,122 | 12/1995 | Appleby . | |
| 5,603,436 | 2/1997 | Leoncavallo et al. . | |
| 5,676,289 | 10/1997 | Gross et al. . | |
| 5,680,969 | 10/1997 | Gross . | |
| 5,692,651 | 12/1997 | Fuchs . | |
| 5,704,522 | 1/1998 | Orgeolet et al. . | |
| 5,727,714 | 3/1998 | Fawcett | 222/175 |
| 5,839,626 | 11/1998 | Gross et al. . | |
| 5,842,618 | 12/1998 | Julemont et al. . | |
| 5,850,908 | 12/1998 | Jasek . | |
| 5,857,595 | 1/1999 | Nilson . | |
| 5,913,456 | 6/1999 | Dikeman | 222/175 |

*Primary Examiner*—Philippe Derakshani
*Attorney, Agent, or Firm*—Rockey, Milnamow & Katz, Ltd.

[57] ABSTRACT

A dispensing system is provided for dispensing liquid from a container. The system includes a discharge conduit defining a flow passage for establishing fluid communication with liquid from the container. A resilient valve is provided to extend across the discharge flow passage in an initial, substantially non-deformed, closed configuration. The valve has an interior side for being contacted by the liquid and an exterior side exposed to ambient external atmosphere. The valve defines a normally closed dispensing orifice that is displaceable outwardly to an open configuration when the pressure on the valve interior side exceeds the pressure on the valve exterior side by a predetermined amount, and is displaceable inwardly to an open configuration when the pressure on the valve exterior side exceeds the pressure on the valve interior side by a predetermined amount. A restraint structure is disposed in the discharge conduit in contact with the valve interior side when the valve is in the initial, substantially non-deformed, closed configuration. The restraint structure and the discharge conduit together define at least one flow path accommodating flow of the liquid from the container against at least a portion of the valve interior side. The restraint structure prevents the closed dispensing orifice from opening inwardly when the ambient external pressure on the valve exterior side exceeds the pressure on the valve interior side.

12 Claims, 14 Drawing Sheets

VALVED DISPENSING SYSTEM WITH PRIMING LIQUID LOSS PREVENTION

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a liquid dispensing system for dispensing liquid from a container through a conduit controlled by a resilient valve of the type which has a normally closed dispensing orifice that (1) is displaceable outwardly to an open configuration when the pressure on the valve interior side exceeds the pressure on the valve exterior side by a predetermined amount, and (2) is displaceable inwardly to an open configuration when the pressure on the valve exterior side exceeds the pressure on the valve interior side by a predetermined amount. The system is particularly suitable for incorporation in a portable drink supply system which includes a liquid container, an attached conduit or spout from which a liquid may be directed from the container to a person's mouth, and an internal, resilient, self-sealing, slit-type valve.

BACKGROUND OF THE INVENTION AND TECHNICAL PROBLEMS POSED BY THE PRIOR ART

Various types of portable, dispensing drink containers have become popular. One type of container comprises a generally flexible bottle with a capped spout. The cap can be removed, the bottle can be tipped towards a person's mouth, and then the bottle can be squeezed to direct a stream of liquid (e.g., water, a commercial sports drink, etc.) into the person's mouth.

During some activities, a person may not want to lift and tip a bottle into his or her mouth. For example, in long distance running, bicycling, or other sporting activities, drinking from a small bottle during the activity can be distracting and interfere with concentration on the activity.

Commercial sport hydration systems have been developed and are currently available to address this need. One type of conventional sport hydration system includes a backpack in which is disposed a liquid-impervious, flexible, collapsible, liquid-containing pouch. The backpack includes shoulder straps which permits the backpack to be worn on the user's back. The backpack may include a conventional or special access means, such as zippers or the like, which permit the user to gain access to the interior, liquid-containing pouch for filling the pouch with water or other liquid. The bottom of the liquid-containing pouch in the backpack is connected to an elongate, flexible tube which projects through the backpack and which is generally long enough to reach the person's mouth when the backpack is properly carried on the person's back. The distal end of the tube is provided with a dispensing conduit which is adapted to be inserted into the person's mouth. The person may suck through the dispensing conduit assembly to withdraw liquid.

In one such commercially available sport hydration system, the dispensing conduit assembly includes a resilient valve at the end of the dispensing assembly which defines a slit that is normally closed. When the dispensing conduit assembly is inserted into the person's mouth, the person can bite down on the exterior of the valve at a portion of the valve adjacent the slit. This causes the slit to open slightly so that the liquid can be sucked from the tube through the open slit.

While the above-described sport hydration system may function generally satisfactorily, it would be desirable to provide an improved system which would not require the user to bite down on a portion of the dispensing conduit assembly in order to open the valve prior to attempting to suck liquid out through the valve. Preferably, such an improved system should include a valve that will open relatively easily when a person begins to suck on the dispensing conduit assembly. Further, the valve should close when the person stops sucking on the dispensing conduit assembly, and the valve should not open inwardly to allow air to enter below the valve in the dispensing conduit assembly. If air were to enter below the valve, the liquid in the dispensing conduit assembly below the valve and in the tubing extending through the bottom of the backpack would tend to recede from the valve toward the backpack. Subsequently, when the user wants to drink some more of the liquid, the user would have to suck harder and longer to bring the liquid in the tube back up to, and through, the valve. Thus, an improved system employing a valve should prevent ingress of air below the valve that would otherwise lead to a loss of priming liquid below the valve. Such an improved system could accommodate the normal, easy dispensing of the liquid when a person desires to obtain a drink.

Such an improved system should also desirably withstand rugged handling or abuse without leaking.

It would also be advantageous if such an improved system could accommodate liquid-containing devices that have a variety of shapes and that are constructed from a variety of materials.

Further, it would be desirable if such an improved system could accommodate efficient, high-quality, large volume manufacturing techniques with a reduced product reject rate to produce a system with consistent operating characteristics.

The present invention provides an improved system which can accommodate designs having the above-discussed benefits and features.

BRIEF SUMMARY OF THE INVENTION

The present invention provides a system for accommodating the dispensing of a liquid from a container through a conduit or spout into a person's mouth. The system employs a resilient valve that can open outwardly or inwardly. The improved system eliminates, or substantially minimizes, the tendency of the valve to open inwardly and allow air into the system below the valve which would lead to a loss of the priming liquid below the valve.

According to one aspect of the present invention, the dispensing system includes a discharge conduit defining a flow passage for establishing communication with liquid from a container.

A resilient valve extends across the discharge conduit flow passage in an initial, substantially non-deformed, closed configuration. The valve has an interior side for being contacted by the liquid and an exterior side exposed to the ambient external atmosphere. The valve defines a normally closed dispensing orifice that is displaceable outwardly to an open configuration when pressure on the valve interior side exceeds the pressure on the valve exterior side by a predetermined amount. The valve is displaceable inwardly to an open configuration when the pressure on the valve exterior side exceeds the pressure on the valve interior side by a predetermined amount—however, an aspect of the present invention functions to prevent the valve from being displaced inwardly to an open configuration. In a preferred embodiment, the valve is a resilient, self-sealing, slit-type valve.

A restraint structure is disposed in the discharge conduit in contact with the valve interior side when the valve is in the initial, substantially non-deformed, closed configuration. This prevents the valve orifice from being displaced inwardly to the open configuration. Hence, after a person stops sucking on the dispensing system, air cannot vent in to cause loss of the priming liquid from below the valve.

The restraint structure and the conduit together define at least one flow path accommodating flow of liquid from the container against at least a portion of the valve interior side. Thus, when the pressure on the interior side of the valve exceeds the pressure on the valve exterior side by a predetermined amount, the dispensing orifice is displaced outwardly to an open configuration to permit the liquid to be discharged from the dispensing system.

In a preferred design, the dispensing system also includes a resilient baffle, although such a baffle is necessary to operation of the system. In particular, the resilient baffle is located upstream of the valve and restraint structure. The resilient baffle eliminates, or substantially minimizes, the tendency of the valve to open outwardly under transient pressure conditions, such as "water hammer" or other hydraulic hammer conditions that can occur when the system (or portion thereof) is dropped or knocked over. This will prevent, or at least substantially minimize, the likelihood of liquid inadvertently leaking from the system during such conditions.

The baffle includes an occlusion member supported by at least one resilient support member which (1) accommodates movement of the occlusion member between a closed position occluding flow into at least a portion of the conduit flow passage adjacent the valve when the baffle is subjected to an upstream hydraulic hammer pressure, and (2) biases the occlusion member to an open position permitting flow into the conduit flow passage adjacent the valve when the baffle is not subjected to the hydraulic hammer pressure.

In a preferred design, the dispensing system includes an annular seat inwardly of the valve, between the baffle and the valve. The baffle preferably includes a disk-like central occlusion member connected to an annular support wall with a plurality of support members which (1) are normally biased to maintain the occlusion member spaced inwardly from the seat to accommodate flow through the conduit to the valve, and (2) accommodate movement of the occlusion member outwardly against the seat when the occlusion member is subjected to a hydraulic hammer pressure exceeding a predetermined amount.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the system of this invention is described in an upright position, and terms such as upper, lower, horizontal, etc., are used with reference to this position. It will be understood, however, that the system of this invention may be manufactured, stored, transported, used, and sold in an orientation other than the upright position described herein.

Figure 1:
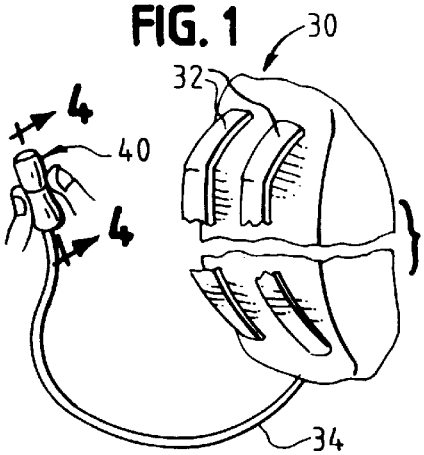
FIG. 1 is a perspective view of the dispensing system of the present invention incorporated in a sport hydration system which includes a liquid-containing backpack, delivery tube, and dispensing conduit assembly.

FIG. 1 shows a preferred form of the invention in the form of a dispensing system included as part of a sport hydration system. The sport hydration system includes a backpack 30 in which is disposed a liquid impervious, flexible, collapsible, liquid-containing pouch (not visible). The backpack 30 includes special or conventional shoulder straps 32 which permit the backpack 30 to be worn on the user's back.

The backpack 30 preferably includes conventional or special access means, such as zippers or the like, which permit the user to gain access to the interior, liquid-containing pouch for filling the pouch with water or other liquid.

The bottom of the liquid-containing pouch in the backpack 30 is connected to an elongate, flexible tube 34 which projects through a suitable opening in the bottom of the backpack 30 and which is generally long enough to reach a person's mouth when the backpack 30 is properly carried on a person's back. The backpack structure, insofar as it has been described, may be of any suitable special or conventional design, the details of which form no part of the present invention.

Figure 2:
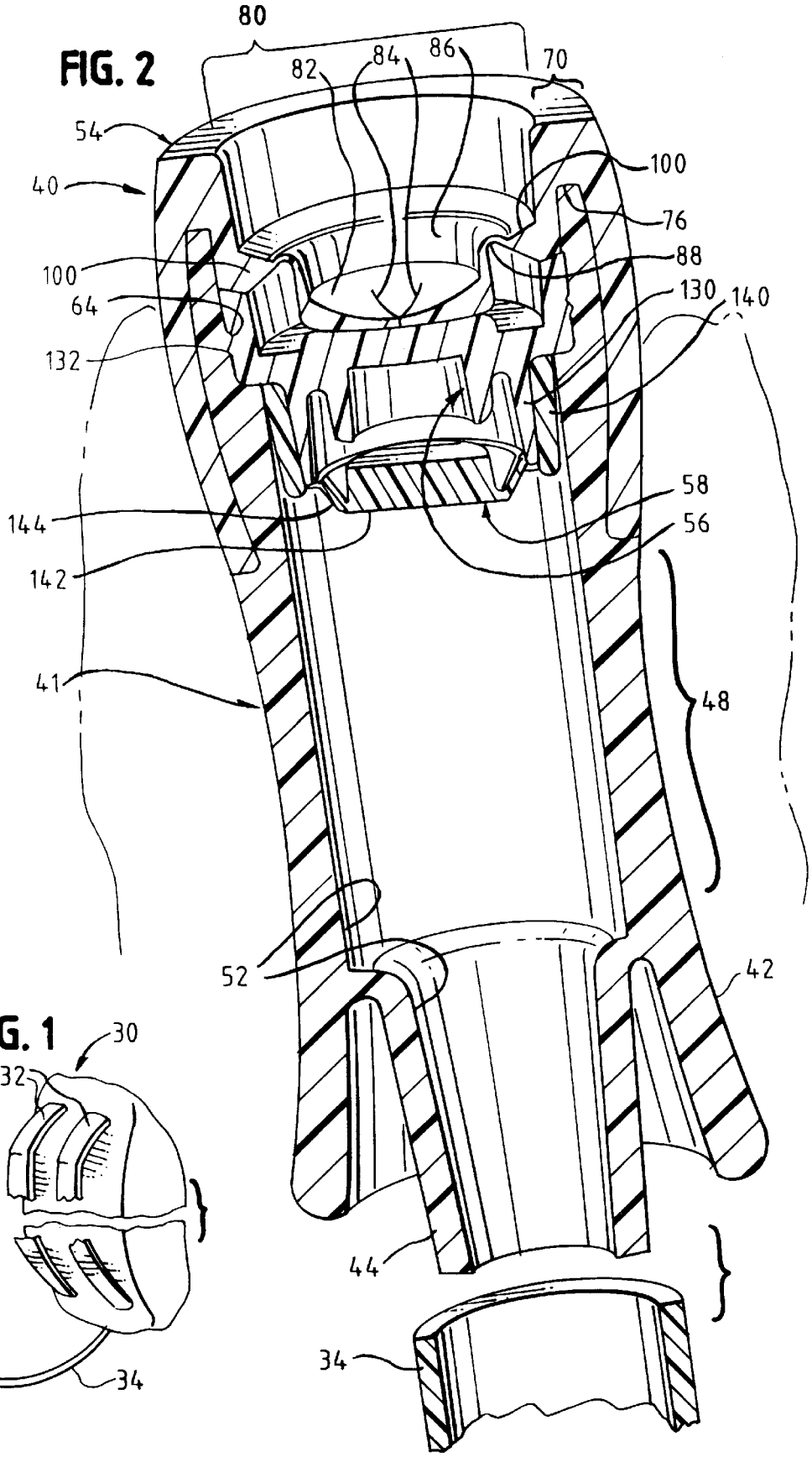
FIG. 2 is a greatly enlarged, fragmentary, exploded perspective, cross-sectional view of the dispensing conduit assembly.

The distal end of the tube 34 is provided with a dispensing conduit assembly 40 which is adapted to be inserted into a person's mouth. The person may suck through the dispensing conduit assembly 40 to withdraw liquid. As shown in FIG. 2, the dispensing conduit assembly 40 includes a discharge conduit 41 which has an inlet end defined by an outwardly flared bottom skirt 42 and an inner, tapered, male fitting 44 which is preferably formed as a unitary part of the discharge conduit 41. The tapered, male fitting 44 is adapted to be received within the distal end of the tube 34 and secured thereto by suitable means, such as a friction fit, and/or with a suitable bonding material, weld, or the like. The detailed design and construction of the attachment of the discharge conduit 41 to the tube 34 forms no part of the present invention.

Figure 5:
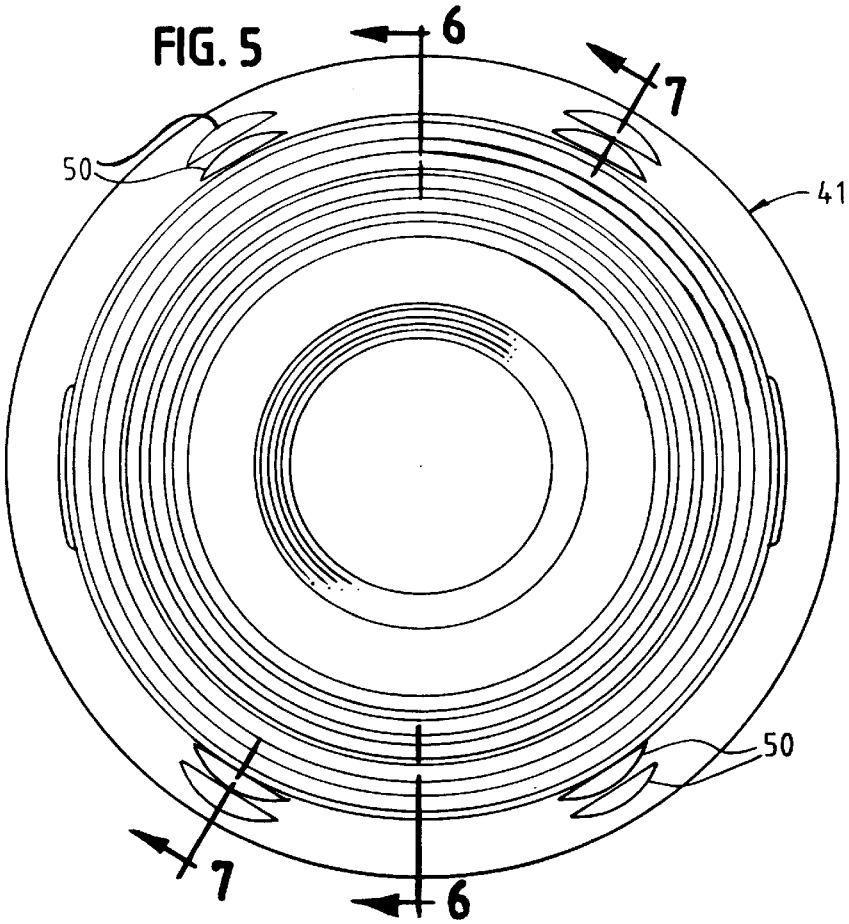
FIG. 5 is a greatly enlarged, top, plan view of the outer end of the discharge conduit with the other components of the dispensing conduit assembly omitted.
Figure 6:
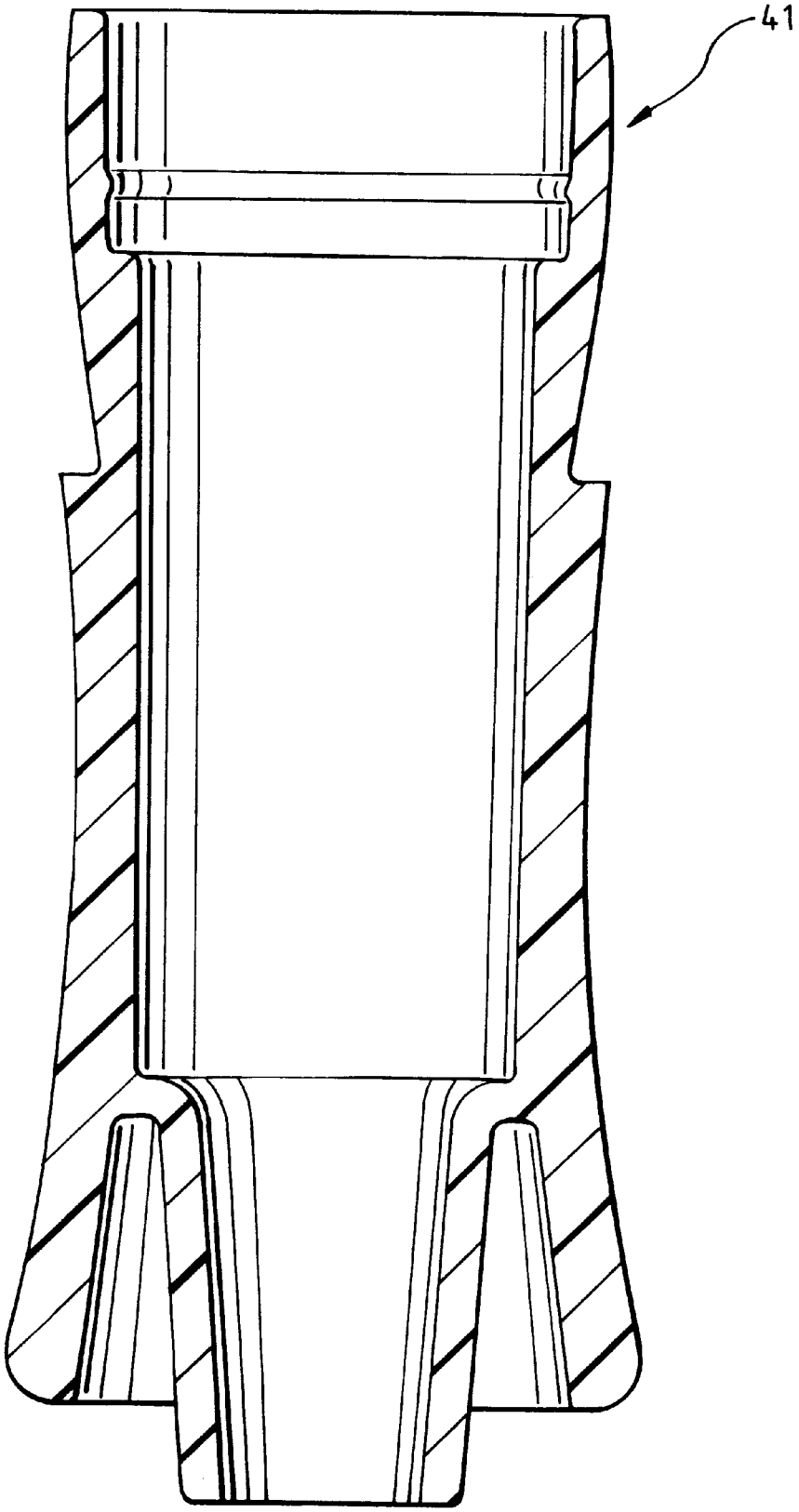
FIG. 6 is a reduced, cross-sectional view taken generally along the plane 6—6 in FIG. 5.

The discharge conduit 41 includes a central body portion 48, the exterior of which has a plurality of circumferentially spaced-apart protrusions or bumps 50 (FIG. 5) axially disposed along the length of the central portion 48 to provide a gripping aid. The discharge conduit 41 defines an internal flow passage 52 for establishing flow communication with the liquid from the container via the tube 34. In a preferred form, the discharge conduit 41 is a substantially rigid structure molded from a thermoplastic polymer, such as polypropylene.

The dispensing conduit assembly 40 includes, in addition to the discharge conduit 41, a cap valve 54 at the distal end of the discharge conduit 41, and a restraint structure 56 inwardly of the cap valve 54. In a most preferred embodiment, the dispensing conduit assembly 40 also includes an optional hydraulic hammer baffle 58 inwardly of the restraint structure 56.

Figure 7:
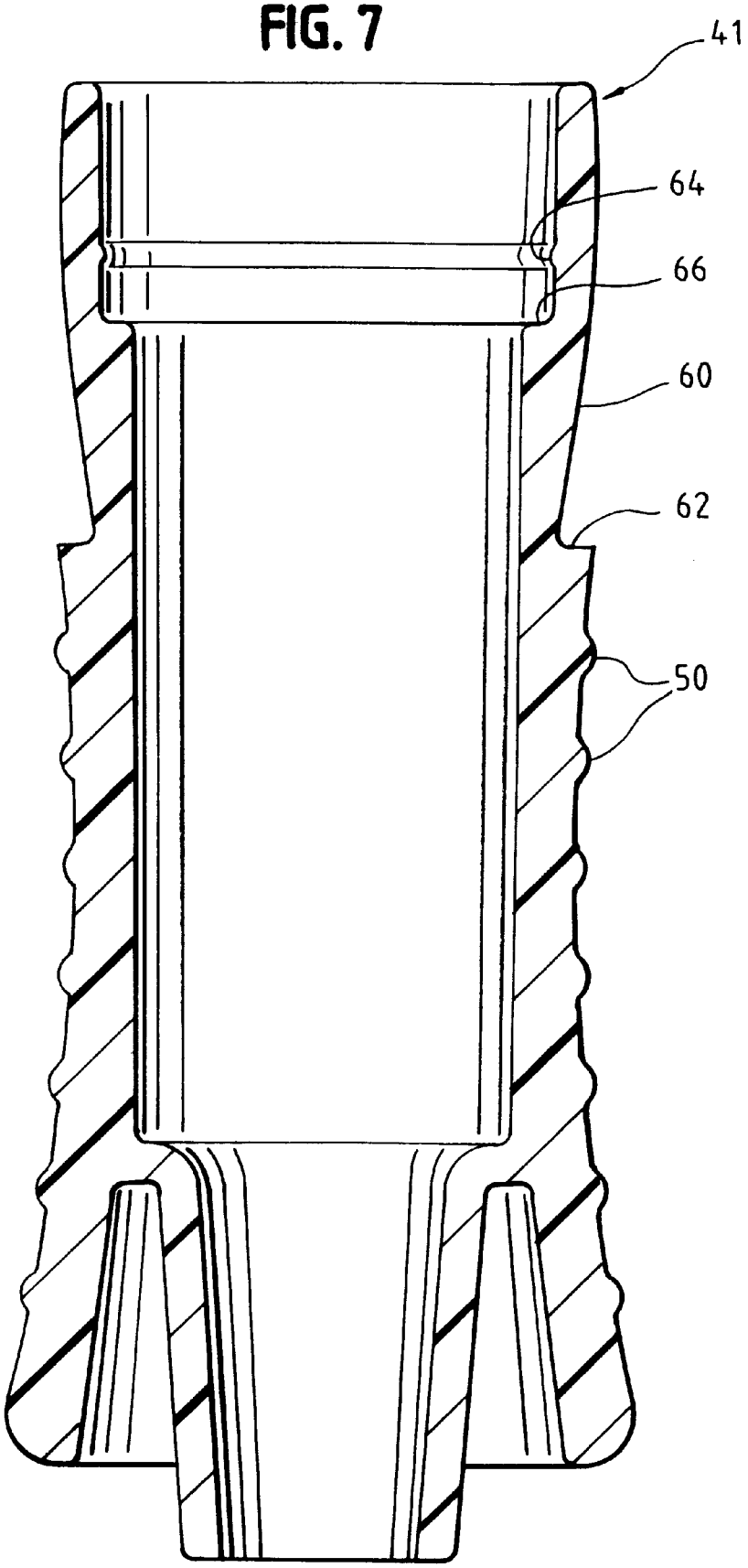
FIG. 7 is a reduced, cross-sectional view taken generally along the plane 7—7 in FIG. 5.
Figure 8:
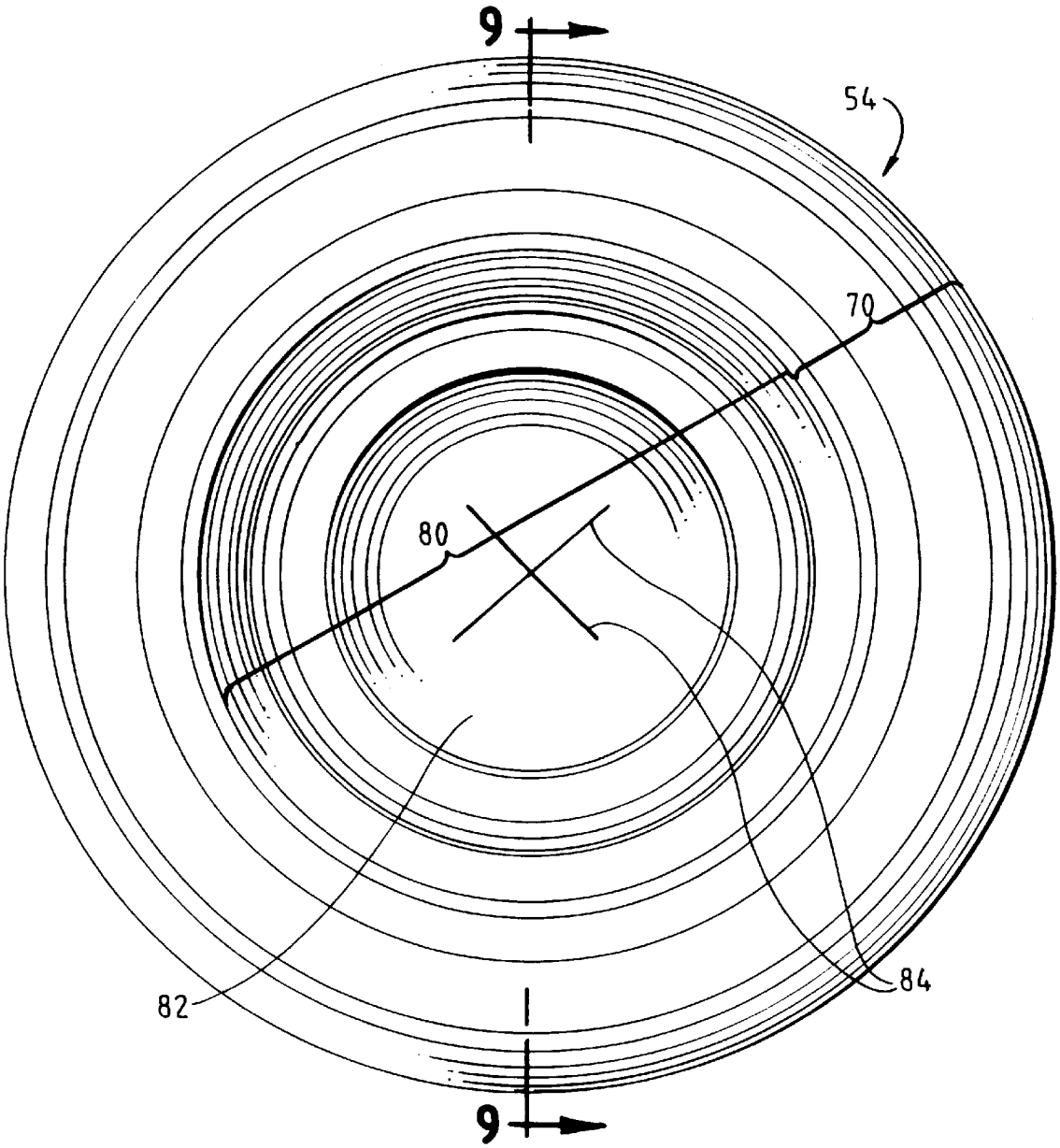
FIG. 8 is an enlarged, top, plan view of the unitary cap valve shown removed from the discharge conduit.

The cap valve 54, the restraint structure 56, and the baffle 58 are mounted on and within the discharge conduit 41 so as to form an integral assembly defining the dispensing conduit assembly 40. To this end, as shown in FIG. 7, the distal end of the discharge conduit 41 is specially adapted to receive the cap valve 54, restraint structure 56, and baffle 58. The distal end of the discharge conduit 41 includes an exterior, inwardly tapering surface 60 terminating in an annular shoulder 62. At the distal end of the discharge conduit 41, the interior of the discharge conduit 41 includes a radially inwardly projecting, annular bead 64 and a radially inwardly extending shoulder 66. The surface 60, shoulder 62, bead 64, and shoulder 66 are adapted to receive and engage portions of the cap valve 54 and restraint structure 56 at the distal end of the discharge conduit 41 as described in detail hereinafter.

Figure 3:
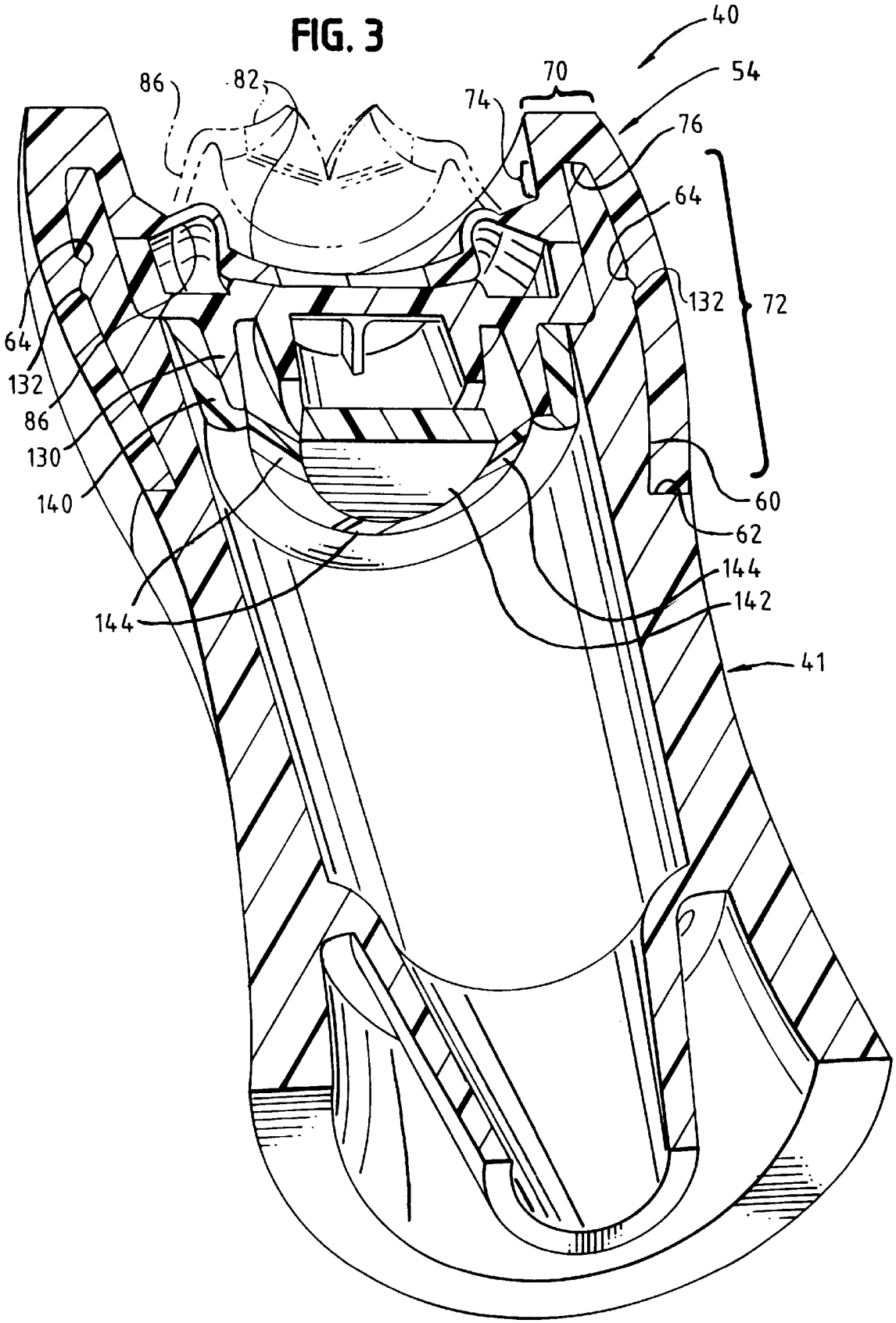
FIG. 3 is a view similar to FIG. 2, but FIG. 3 shows the dispensing conduit assembly as viewed from the inner end.
Figure 9:
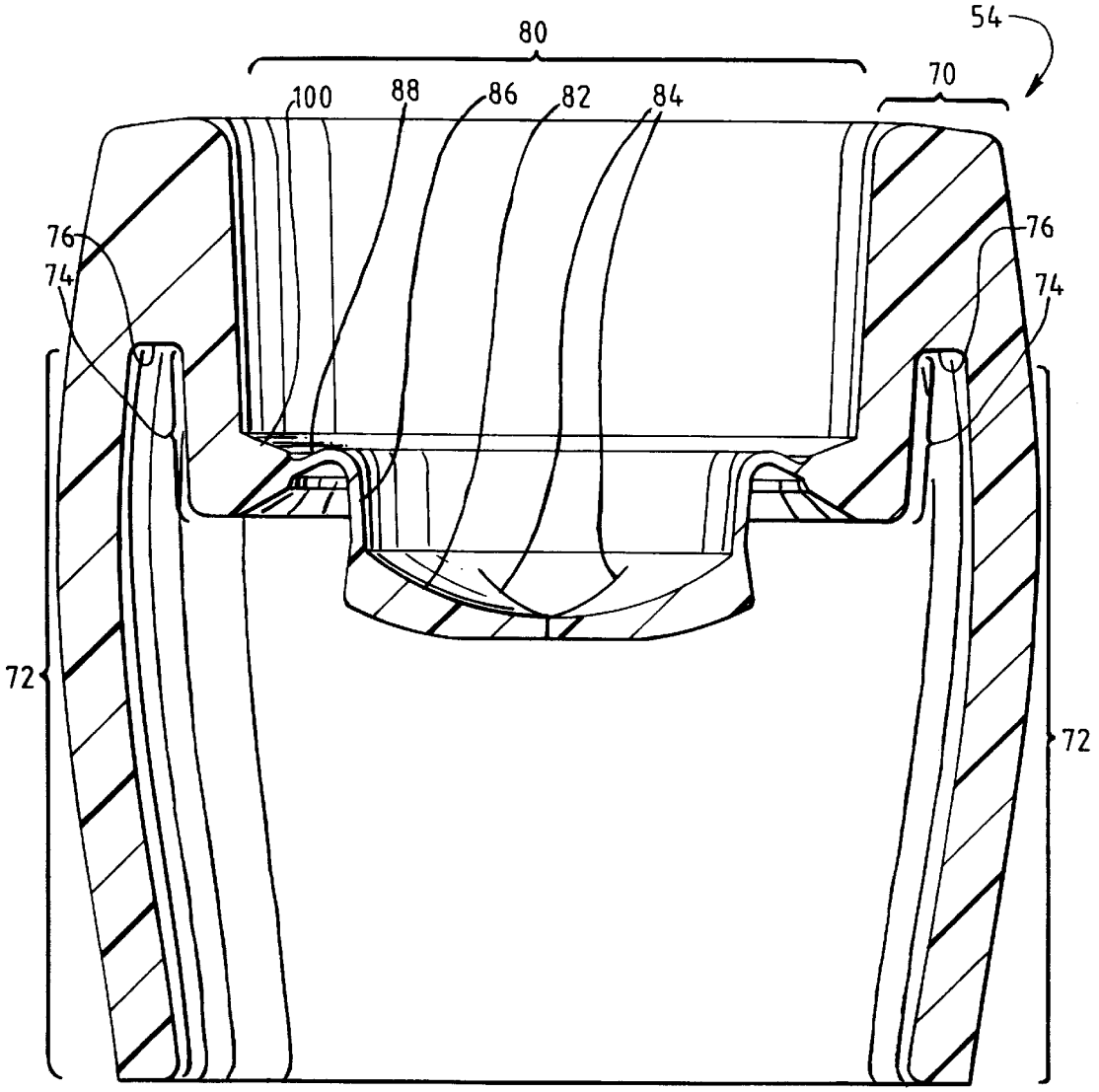
FIG. 9 is a cross-sectional view taken generally along the plane 9—9 in FIG. 8.

The cap valve 54 includes an annular end cap portion 70 (FIG. 9). The periphery of the end cap portion 70 extends downwardly to define a skirt 72, and the inner side of the annular end cap portion 70 extends downwardly to define an inner sleeve 74. The inner sleeve 74 is spaced radially inwardly from the skirt 72, and an annular channel 76 is defined between the inner sleeve 74 and skirt 72. The cap valve channel 76 is adapted to receive the upper, distal end of the discharge conduit 41, as shown in FIG. 3, so that the bottom end of the skirt 72 abuts the ends of the discharge conduit shoulder 62.

Figure 4:
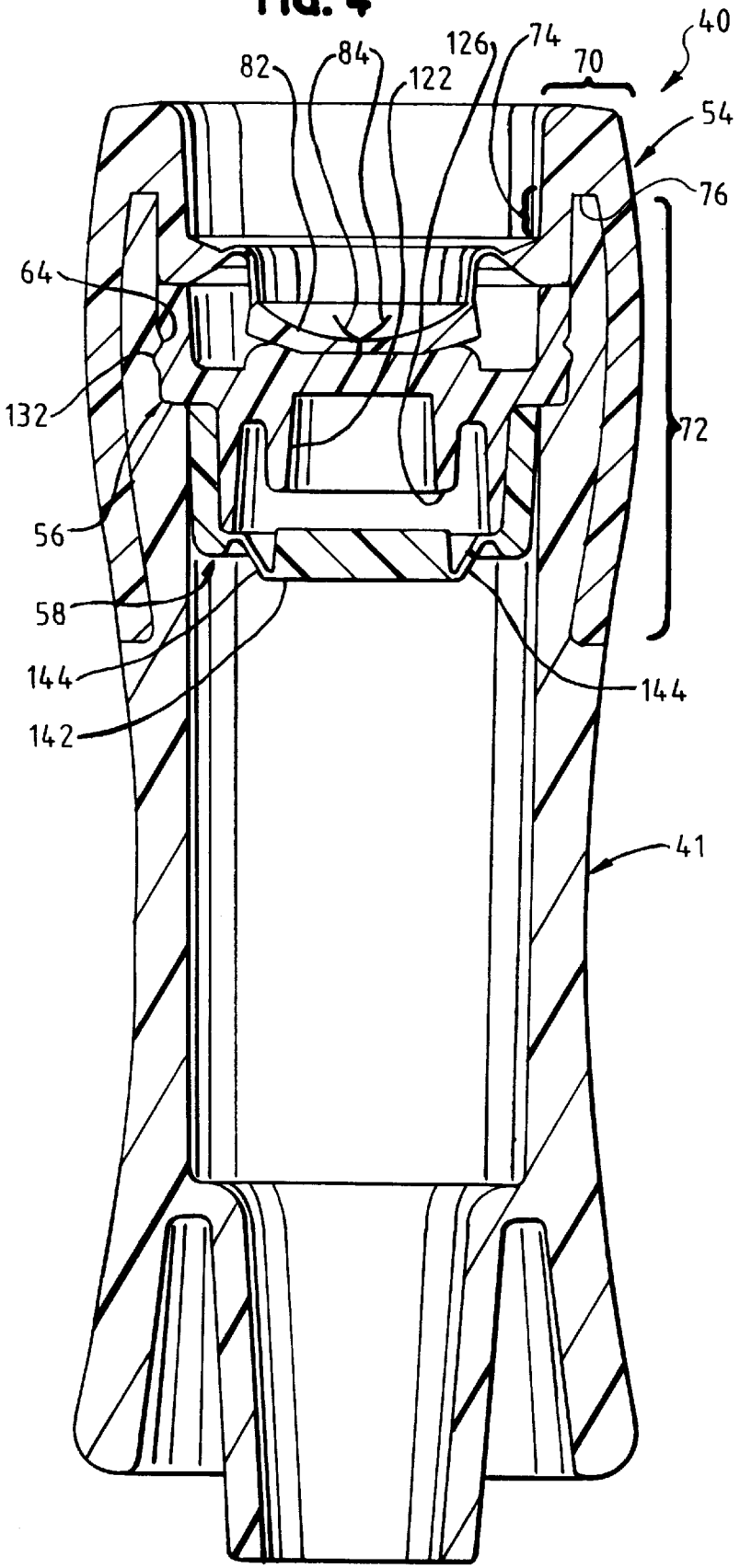
FIG. 4 is a cross-sectional view of the dispensing conduit assembly taken generally along the plane 4—4 in FIG. 1.

The preferred form of the cap valve 54 in the first embodiment illustrated in FIGS. 1–16 is molded from a thermosetting elastomeric material, such as silicone rubber, natural rubber, and the like. The valve could also be molded from a thermoplastic elastomer. Preferably, the valve cap 54 is molded from silicone rubber, such as the silicone rubber sold by Dow Chemical Company in the United States of America under the trade designation DC-595. The valve cap 54, when molded from this material, is flexible, pliable, elastic, and resilient so that the skirt 72 can be stretched around, and sealingly engaged with, the discharge conduit exterior curved surface 60 so as to tightly mount the cap valve 54 on the distal end of the discharge conduit 41 with the annular distal end of the discharge conduit 41 squeezed between the skirt 72 and the inner sleeve 74 as shown in FIGS. 3 and 4.

As shown in FIG. 9, the cap valve 54 includes a centrally disposed valve portion or valve 80. The valve 80 is a unitary molded interior portion of the cap valve 54. The valve 80, in the preferred embodiment illustrated, has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3d in the U.S. Pat. No. 5,409,144. The descriptions of those two patents are incorporated herein by reference to the extent pertinent and to the extent not inconsistent herewith.

As illustrated in FIGS. 2 and 9 herein, the valve 80 includes a head portion or central wall 82 which is flexible and which has an outwardly concave configuration and which defines at least one, and preferably two, dispensing slits 84 extending through the head portion or central wall 80. A preferred form of the valve 80 has two, mutually perpendicular, intersecting slits 84 of equal length. The intersecting slits 84 define four, generally sector-shaped, flaps or petals in the concave, central wall 82. The flaps open outwardly from the intersection point of the slits 84 in response to increasing pressure of sufficient magnitude in the well-known manner described in the above-discussed U.S. Pat. No. 5,409,144.

The valve 80 includes a skirt 86 (FIGS. 2 and 9) which extends outwardly from the valve head portion or central wall 82. At the outer (upper) end of the skirt 86 there is a thin, annular flange 88 (FIGS. 2 and 9) which extends peripherally from the skirt 86 in a downwardly angled orientation. The thin flange 88 terminates in an enlarged, much thicker, peripheral flange 100 which has a generally dovetail shaped transverse cross section.

When the cap valve 54 is properly disposed with the central valve portion or valve 80 in the closed condition on the discharge conduit 41 in FIG. 2, the valve 80 is recessed relative to the top of the end cap 70. However, when a person sucks on the end of the dispensing conduit assembly, the valve central wall 82 is forced outwardly from its recessed position, and liquid flows through the valve 80. More specifically, when the pressure below the valve 80 exceeds the external ambient pressure by a predetermined amount, the valve 80 is forced outwardly from the recessed or retracted position to an extended, open position as shown in phantom with dashed lines in FIG. 3. The valve central wall 82 (which contains the slits 84) is displaced outwardly while still maintaining its generally concave configuration. The outward displacement of the concave, central wall 82 is accommodated by the relatively, thin, flexible, skirt 86. The skirt 86 moves from a recessed, rest position to the pressurized position wherein the skirt 86 is projecting outwardly toward the open end of the dispensing conduit assembly 40.

The valve 80 does not open (i.e., the slits 84 do not open) until the valve central wall 82 has moved substantially all the way to a fully extended position. Indeed, as the valve central wall 82 moves outwardly, the valve central wall 82 is subjected to radially inwardly directed compression forces which tend to further resist opening of the slits 84. Further, the valve central wall 82 generally retains its outwardly concave configuration as it moves forward and even after it reaches the fully extended position. However, if the internal pressure is sufficiently great compared to the external pressure, then the slits 84 of the extended valve 80 begin to open to dispense product.

Figure 13:
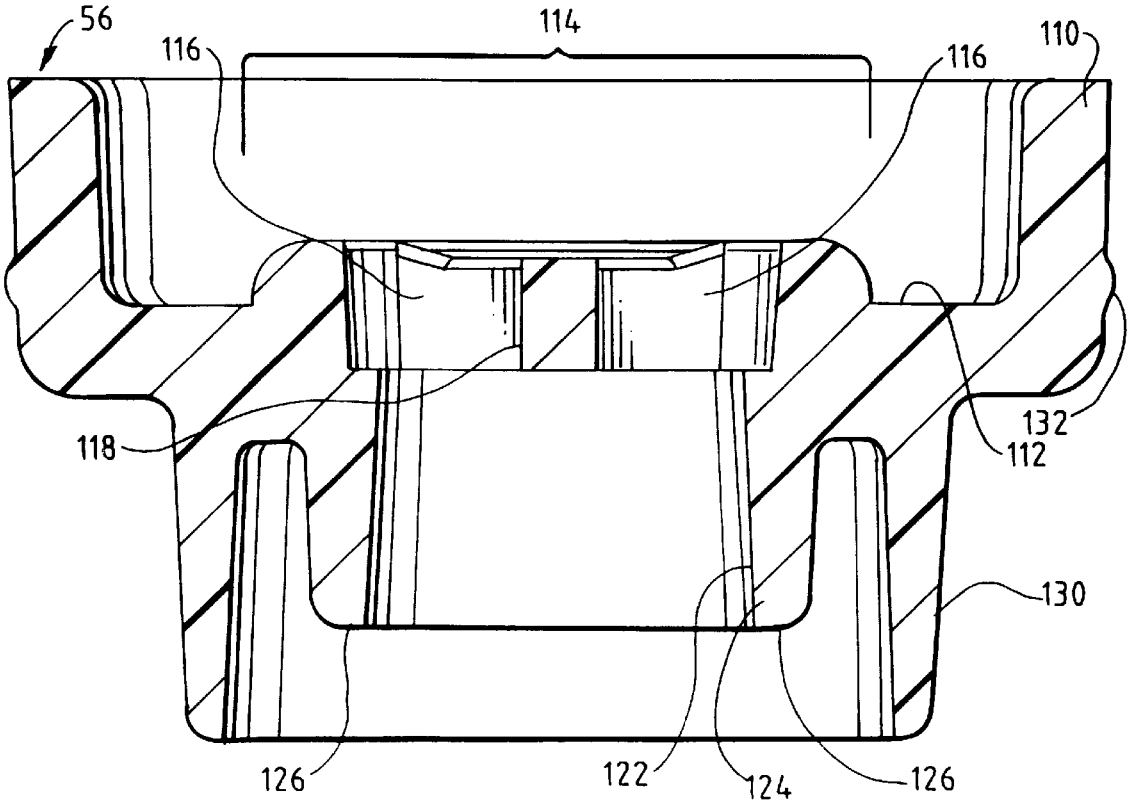
FIG. 13 is a cross-sectional view taken generally along the plane 13—13 in FIG. 11.

FIGS. 10–13 illustrate in detail the restraint structure 56 which is designed to be installed below (inwardly of) the valve 80 as shown in FIGS. 2–4. The structure 56 is preferably molded from a thermoplastic polymer such as polypropylene. As illustrated in FIG. 13, the restraint structure 56 includes an upper annular wall 110, an annular deck 112 extending radially inwardly at the bottom of the annular wall 110, and a central portion 114 radially inwardly of the annular deck 112. The central portion 114 includes four radial support arms or members 116 (FIGS. 11 and 13) which are spaced at 90 degrees and converge at a central post 118.

Figure 11:
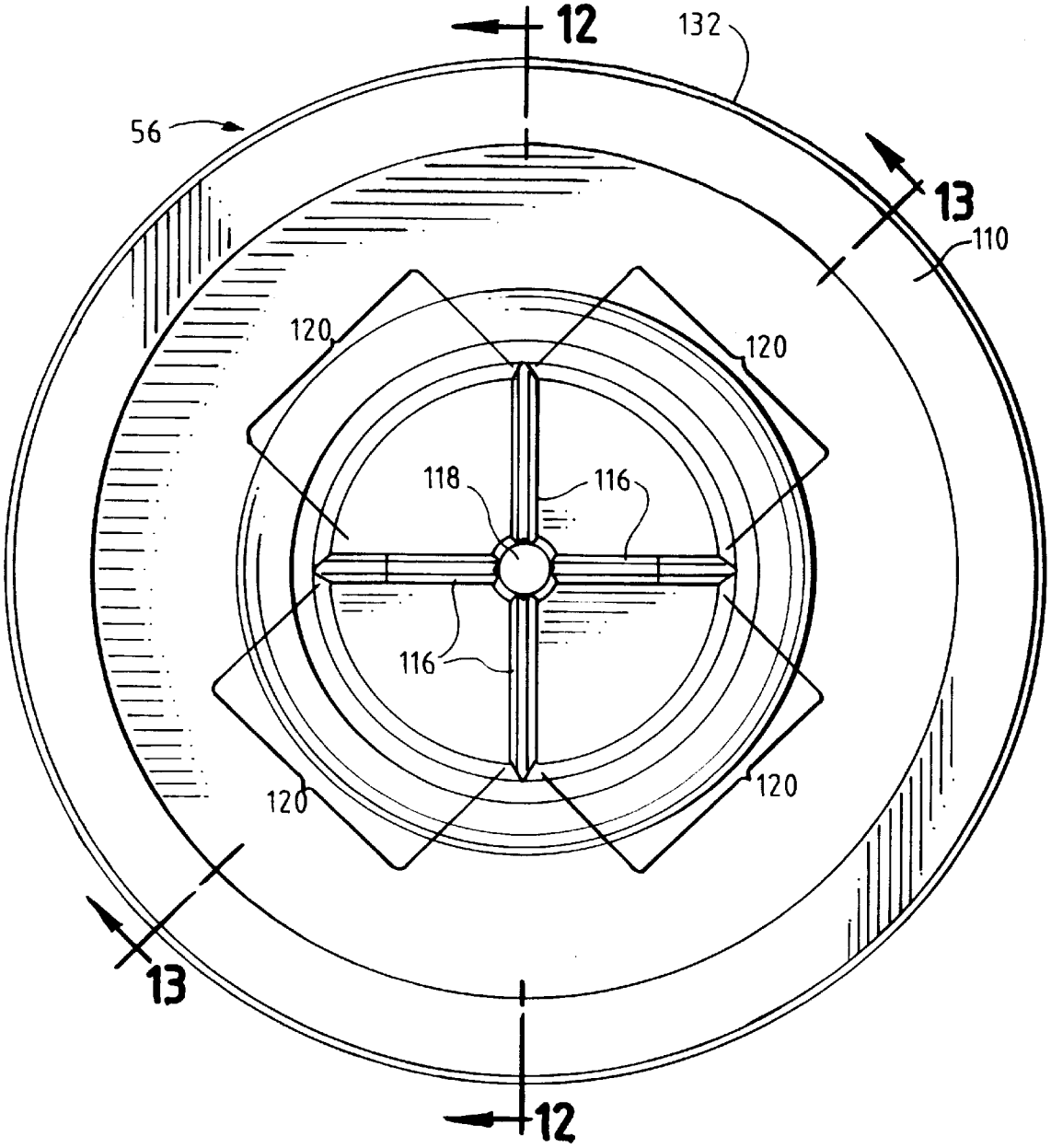
FIG. 11 is a top plan view of the restraint structure shown in FIG. 10.
Figure 12:
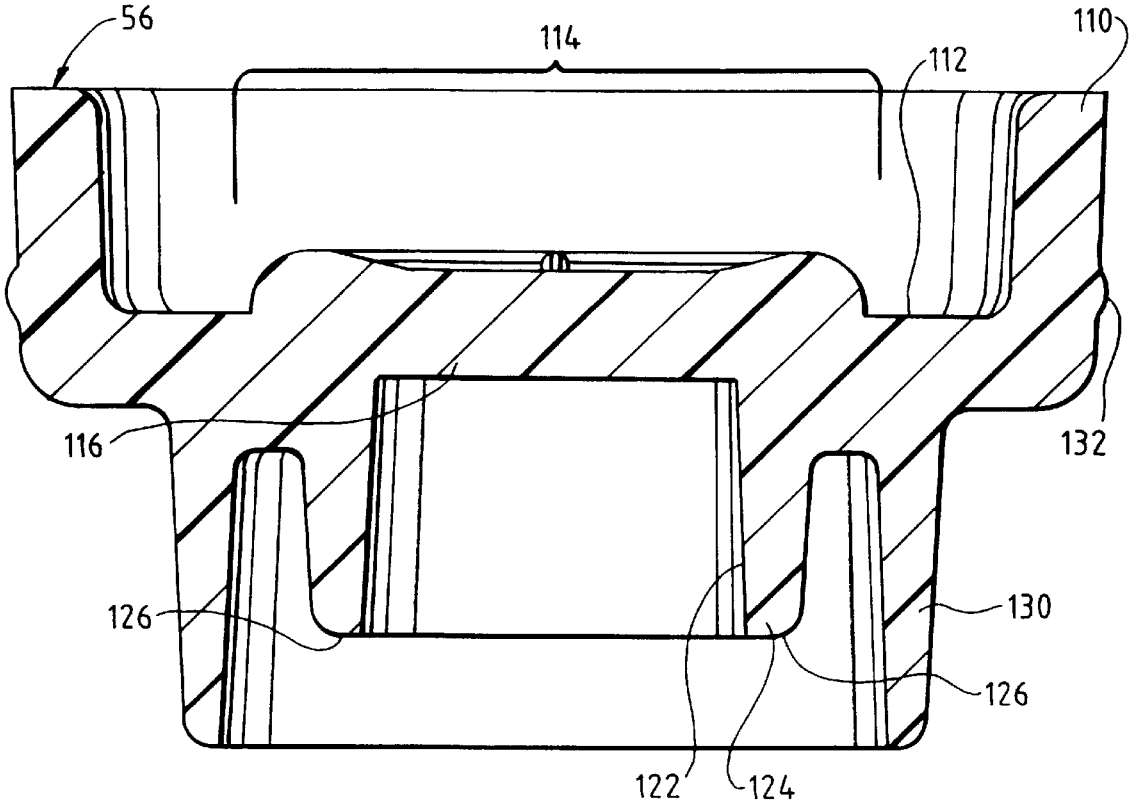
FIG. 12 is a cross-sectional view taken generally along the plane 12—12 in FIG. 11.

As can be seen in FIG. 11, four generally pie-shaped openings 120 are defined by the four support members 116. The openings 120 communicate with a central, tapered bore 122 (FIG. 13) which may be considered as part of the flow passage defined within the discharge conduit 41 when the restraint structure 56 is installed in the discharge conduit 41 as illustrated in FIG. 2. The tapered bore 122 is defined within a downwardly projecting, generally annular seat, member, or ring 124. The bottom end of the seat, member, or ring 124 defines an annular seating surface 126. The seat, member, or ring 124 is located radially inwardly of a surrounding, annular, outer wall 130 which projects downwardly from the deck 112.

Figure 10:
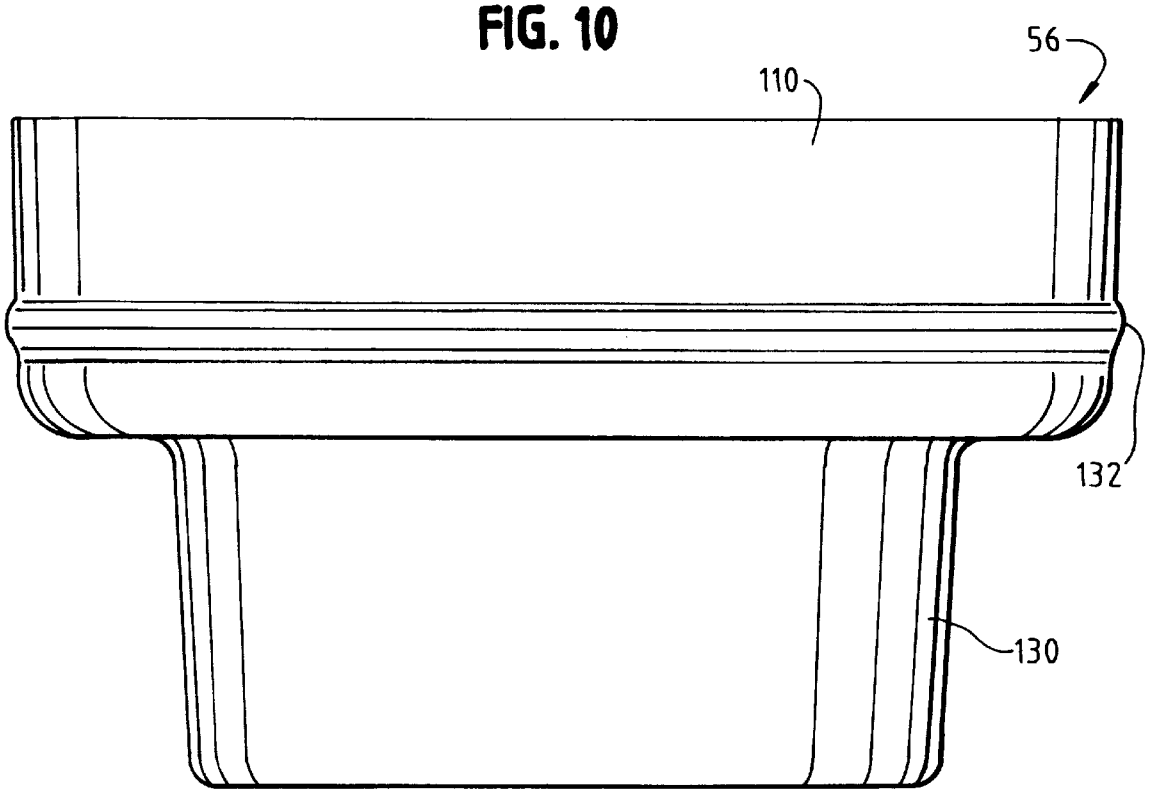
FIG. 10 is a side elevational view of the valve restraint structure shown removed from the discharge conduit.

On the exterior surface of the annular wall 110 of the restraint structure 56, there is an annular bead 132 (FIGS. 10 and 13). The bead 132 is adapted to be moved past the bead 64 (FIG. 7) in the discharge conduit 41 when the restraint structure 56 is initially installed in the open, upper, outlet end of the discharge conduit 41 as shown in FIGS. 2–4. The restraint structure bead 132 establishes a snap-fit engagement with the discharge conduit bead 64 as illustrated in FIG. 4 so as to retain the restraint structure within the discharge conduit 41. To accommodate the snap-fit engagement, the annular, outlet end of the discharge conduit 41 may be somewhat resilient and/or the restraint structure annular wall 110 may be somewhat resilient to accommodate temporary deflection of either or both walls as the bead 64 and bead 132 move past each other into the snap-fit engagement.

The central portion 114 of the restraint structure 56 is designed and positioned within the discharge conduit 41 so as to generally touch, abut, or otherwise engage the rear, downwardly facing surface (inwardly facing surface) of the central wall 82 of the valve 80 as shown in FIGS. 2–4. The valve 80 is substantially non-deformed when properly positioned at the end of the discharge conduit 41 as shown in FIGS. 2–4 with the rear surface (downwardly facing surface) engaging the top surfaces of the support members 116 of the restraint structure 56. The restraint structure 56 prevents the valve central portion 82 from deflecting downwardly (inwardly into the discharge conduit 41) to effect an inward opening of the slits 84. If the valve 80 was permitted to open inwardly, then the column of liquid within the discharge conduit 41 below the valve 80 (and within the flexible tube 34) could flow downwardly back into the backpack container owing to ambient external air passing through the inwardly open valve 80 and into the discharge conduit 41. This undesirable occurrence can be characterized as a loss of system prime which would hinder the normal, easy delivery of liquid that a person would normally expect when sucking the discharge conduit under a fully primed condition wherein liquid occupies the internal volumes of the flexible tubing 34 and discharge conduit up to the elevation of the valve 80.

Because the openings 120 are defined between the support members 116 in the restraint structure 56, liquid can flow up through the openings 120 and against the bottom, downwardly facing surface of the closed valve central portion 82. When a person sucks on the outlet end of the dispensing conduit assembly 40, the reduction in pressure on the outlet side of the valve 80 will eventually become great enough so that the differential pressure existing across the valve 80 will cause the valve 80 to open outwardly and accommodate the flow of liquid into the person's mouth. When the sucking action is terminated, the differential pressure will decrease to the point where the inherent resiliency of the valve 80 will cause it to close. However, the restraint structure 56 will prevent the valve central portion 82 from moving downwardly to an inwardly open position that could cause loss of priming liquid below the valve 80.

Figure 14:
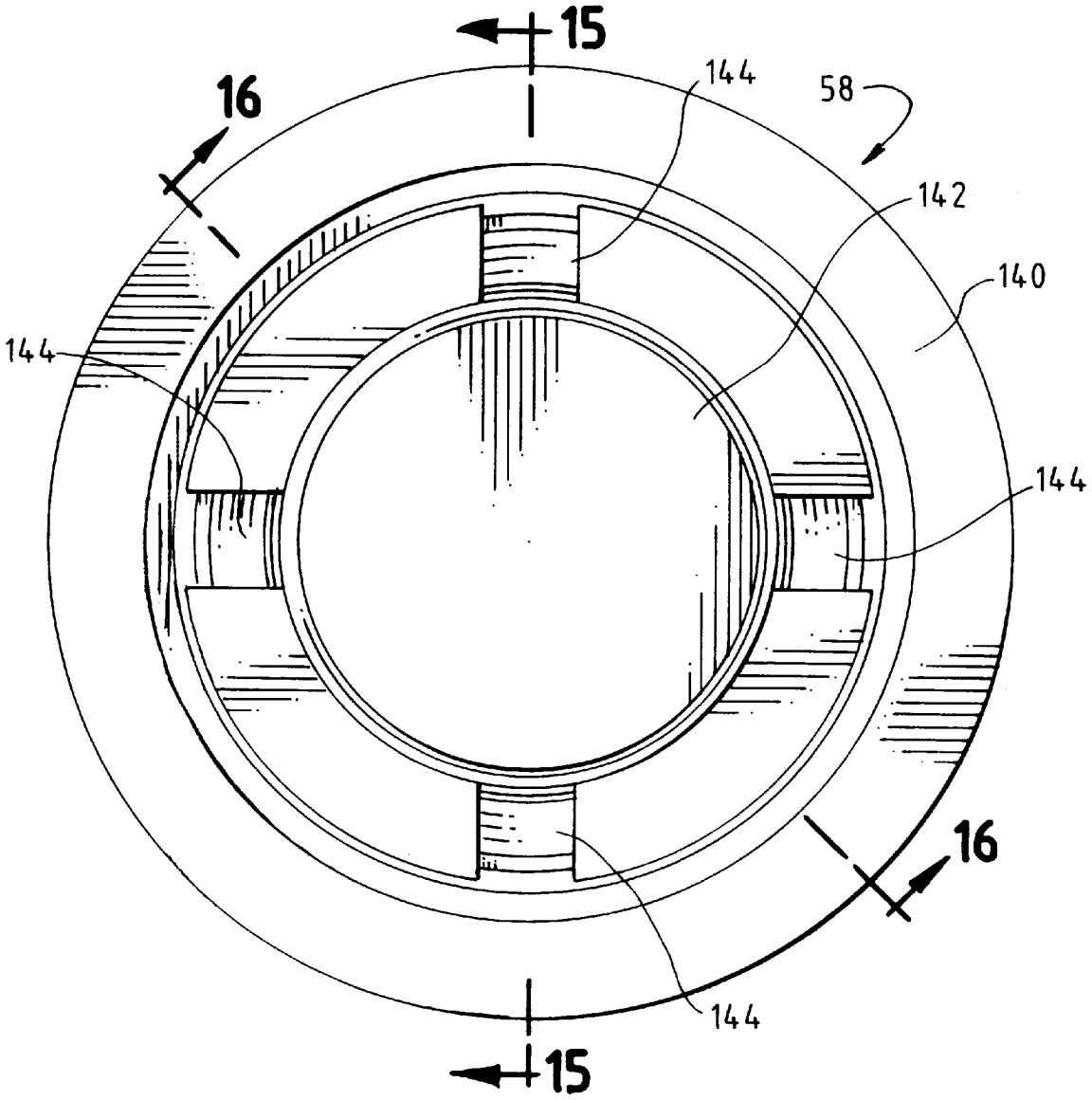
FIG. 14 is a top, plan view of the baffle shown removed from the discharge conduit.
Figure 15:
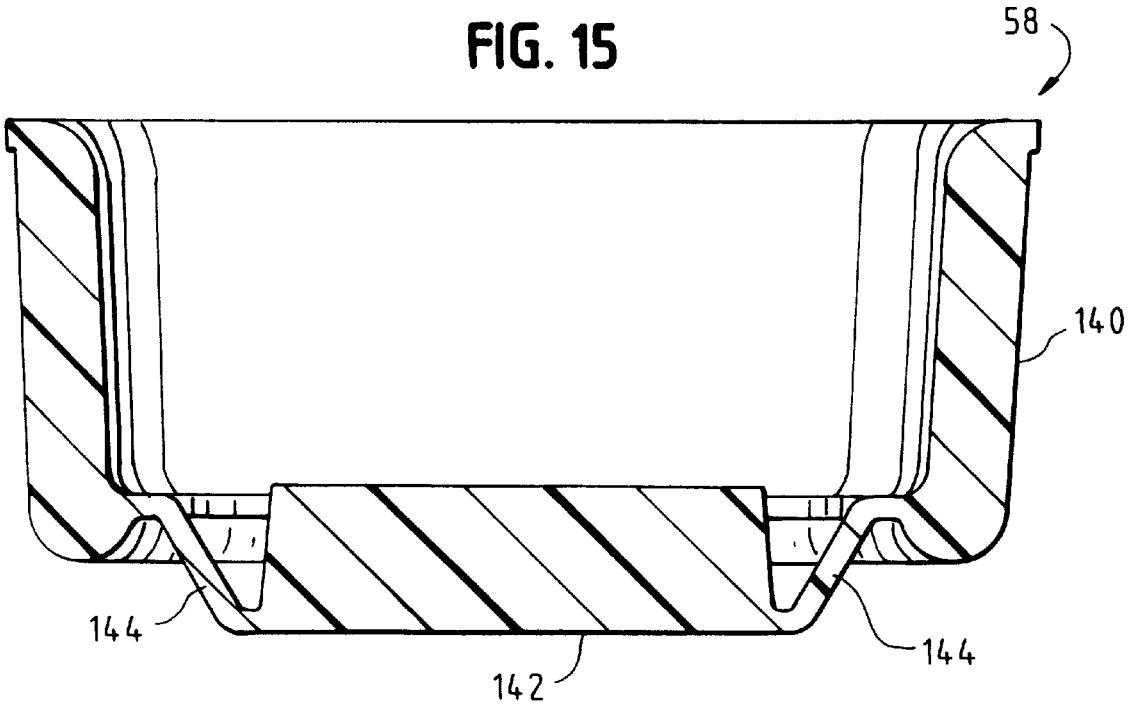
FIG. 15 is a cross-sectional view taken generally along the plane 15—15 in FIG. 14.
Figure 16:
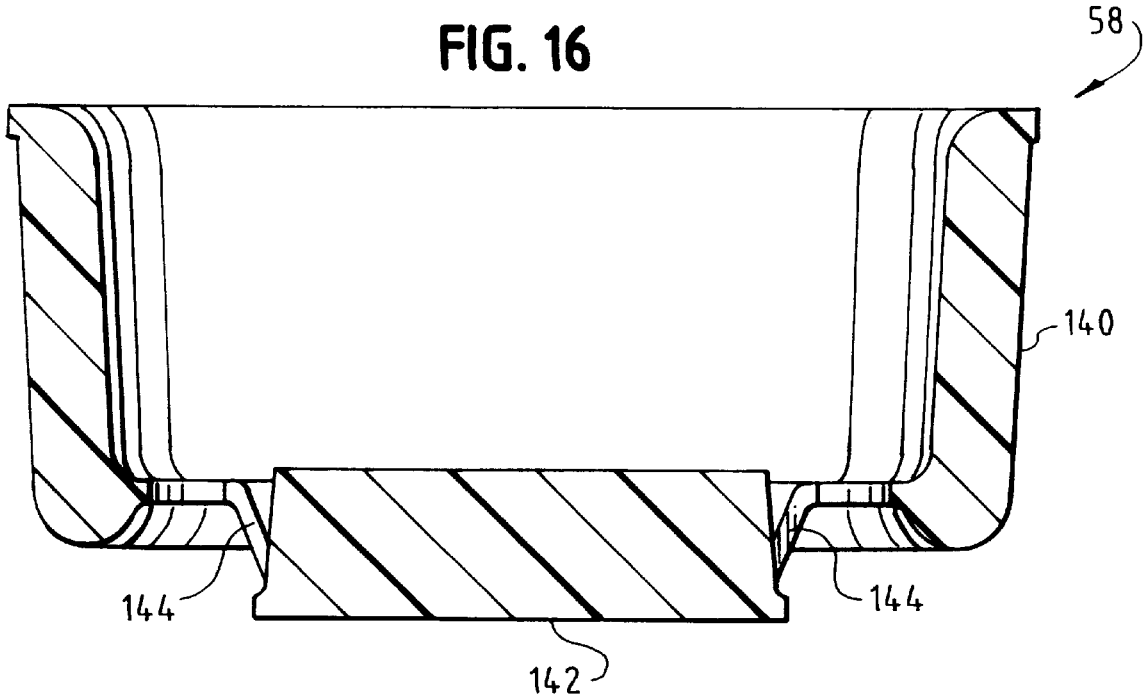
FIG. 16 is a cross-sectional view taken generally along the plane 16—16 in FIG. 14.

FIGS. 14–16 illustrate the optional baffle 58 which is mounted below the restraint structure 56 in the discharge conduit 41 as shown in FIGS. 2–4. The baffle 56 is preferably molded from the same material as the cap valve 54. In particular, the baffle 58 is preferably a flexible, resilient material molded from a thermosetting elastomeric material such as silicone, natural rubber, and the like. In a presently preferred embodiment, the baffle 58 is molded from silicone rubber sold under the trade designation DC-595 in the United States of America by Dow Chemical Company.

The baffle 58, in a preferred form, includes an annular wall 140, a generally circular, disk-like, central occlusion member 142, and at least one, and preferably four, resilient support members 144, which each extends from the periphery of the central occlusion member 142 to the annular wall 140. Each support member 144 biases the occlusion member 142 to an open position (illustrated in FIGS. 2–4 and 14–16) which permits flow between the support members 144 into the upper portion of the conduit flow passage adjacent the bottom surface of the valve 80.

Figure 4A:
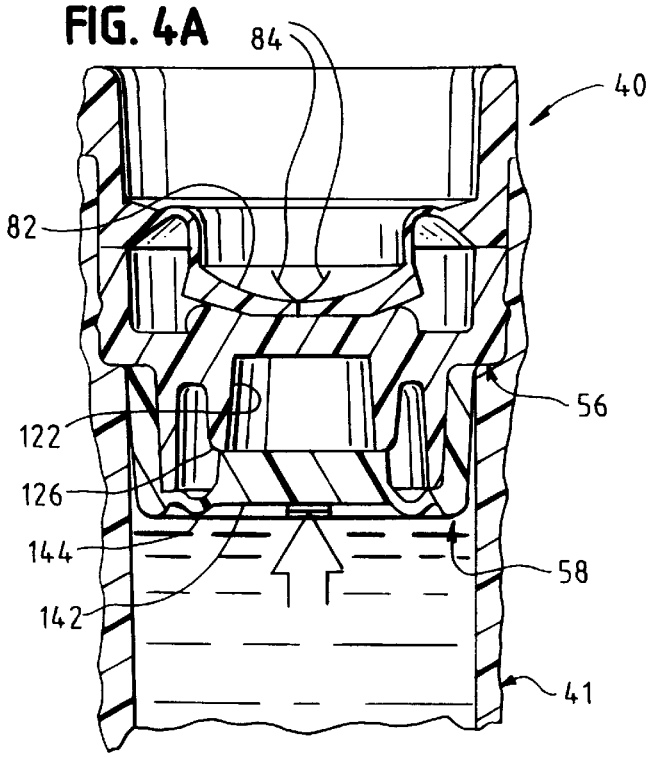
FIG. 4A is a fragmentary view similar to FIG. 4, but FIG. 4A shows the occlusion member moved, in response to an upstream hammer pressure, to a closed position for occluding flow into a portion of the conduit flow passage adjacent the valve.

The support members 144 also accommodate movement of the central occlusion member 142 between the open position illustrated in solid lines in FIGS. 2–3 and a closed position illustrated in solid lines in FIG. 4A. In the closed position illustrated in FIG. 4A, the central occlusion member 142 is seated against the seating surface 126 of the restraint structure 56. This prevents flow through the central bore 122 of the restraint member 56. The normal biasing force of the support members 144 which maintains the central occlusion member 142 in the downwardly disposed, open position (as illustrated in FIGS. 1 and 2) is overcome when a transient pressure differential of sufficient magnitude is applied to the central occlusion member 142. The baffle 58 is designed to maintain the central occlusion member 142 in the downwardly disposed, open position during normal use when liquid is being sucked through the discharge conduit assembly 40. However, if the discharge conduit assembly 40 is dropped and/or if the backpack 30 is dropped, a hydraulic hammer pressure or water hammer may be exerted on the upstream side of the central occlusion member 142 with sufficient magnitude to temporarily move the central occlusion member 142 into sealing engagement against the seating surface 126 of the restraint structure 56. When the central occlusion member 142 closes in response to such a water hammer condition, there will be no flow, or substantially no significant flow, through the valve 80. This will prevent, or at least substantially minimize, leakage through the valve 80 under such transient conditions. After the water hammer or other transient pressure increase has dissipated, the resilient support members 144 bias the central occlusion member 142 downwardly to the open position as illustrated in FIGS. 2 and 3.

Because the baffle 58 is made from a resilient material, such as silicone rubber in the preferred embodiment, the annular wall 140 can be easily stretched over, and retained on, the downwardly projecting annular wall 130 of the restraint member 56 as shown in FIG. 2. The manufacturer can initially mount the baffle 58 and restraint member 56 together as a subassembly outside of the discharge conduit 41. Then the subassembly of the two components can be inserted into the open, upper end of the discharge conduit 41 to effect a snap-fit engagement between the restraint structure annular bead 132 and the discharge conduit annular bead 64 as previously described.

Subsequently, the cap valve 54 is applied to the open, upper end of the discharge conduit 41. The cap valve 54 can also help retain the restraint member 56 within the discharge conduit 41. When properly assembled, the bottom, downwardly facing surface (inwardly facing surface) of the valve central portion 82 just contacts the upwardly facing surfaces of the arms 116 of the restraint member 56.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system for dispensing liquid from a container, said system comprising:

a discharge conduit defining a flow passage for establishing fluid communication with said liquid from said container;

a resilient valve that (1) extends across said discharge conduit flow passage in an initial, substantially non-deformed, closed configuration, (2) has an interior side for being contacted by said liquid and an exterior side exposed to the ambient external atmosphere, and (3) defines a closed dispensing orifice that is displaceable outwardly to an open configuration when the pressure on said valve interior side exceeds the pressure on said valve exterior side by a predetermined amount, and is displaceable inwardly to an open configuration when the pressure on said valve exterior side exceeds the pressure on said valve interior side by a predetermined amount; and a restraint structure disposed in said discharge conduit in contact with said valve interior side when said valve is in said initial, substantially non-deformed, closed configuration, said restraint structure and discharge conduit together defining at least one flow path accommodating flow of said liquid from said container against at least a portion of said valve interior side, said restraint structure preventing said closed dispensing orifice from opening inwardly when the ambient external pressure on the valve exterior side exceeds the pressure on the valve interior side.

2. The dispensing system in accordance with claim 1 in which said discharge conduit has an outlet end defined by an annular end wall; and said valve is part of a larger cap valve structure which includes an elastic outer skirt and an elastic inner sleeve spaced radially inwardly of said outer skirt to define a channel receiving said discharge conduit annular end wall.

3. The dispensing system in accordance with claim 1 in which said valve includes a central wall having two intersecting slits defining said orifice which is closed until the pressure on said valve interior side exceeds the pressure on said valve exterior side by a predetermined amount.

4. The dispensing system in accordance with claim 1 in which said restraint structure includes an annular wall and a plurality of rigid members radiating from a central post to said annular wall to define generally sector-shaped flow passages accommodating flow through said annular wall against said interior side of said valve.

5. The dispensing system in accordance with claim 1 in which said discharge conduit includes a tapered exterior portion; and said valve is part of a larger cap valve structure which includes a resilient, outer skirt having a tapered interior wall for engaging said conduit tapered exterior portion.

6. The dispensing system in accordance with claim 1 in which said valve is part of a larger cap valve structure having an annular end cap portion, and said valve is recessed below said annular end cap portion when said valve is closed.

7. The dispensing system in accordance with claim 1 in which said discharge conduit has an inlet end adapted for connecting to a flexible tube.

8. A dispensing system for dispensing liquid from a container, said system comprising:

a discharge conduit defining a flow passage for establishing fluid communication with said liquid from said container, said discharge conduit having an upstream inlet end and having a downstream outlet end defined by a generally annular outlet end wall;

a cap valve structure which includes (1) an annular end cap portion having an elastic outer skirt and an elastic inner sleeve spaced radially inwardly of said outer skirt to define a channel receiving said discharge conduit annular outlet end wall which is snugly clamped between said inner sleeve and said outer skirt, and (2) a resilient valve that (a) extends from said inner sleeve across said discharge conduit flow passage in an initial, substantially non-deformed, closed configuration, (b) has an interior side for being contacted by said liquid and an exterior side exposed to the ambient external atmosphere, and (c) has a central wall having two intersecting slits which define a normally closed dispensing orifice that is displaceable outwardly to an open configuration when the pressure on said valve interior side exceeds the pressure on said valve exterior side by a predetermined amount, and is displaceable inwardly to an open configuration when the pressure on said valve exterior side exceeds the pressure on said valve interior side by a predetermined amount; and a restraint structure disposed in said discharge conduit upstream of said cap valve, said restraint structure including (1) an outer annular wall engaged with said discharge conduit, (2) an inner annular wall, and (3) a plurality of rigid members radiating from a central post to said inner annular wall to define generally sector-shaped flow passages accommodating flow through said inner annular wall against said valve central wall, said rigid members being in contact with said valve central wall on said interior side of said valve when said valve is in said initial, substantially non-deformed, closed configuration to prevent said closed dispensing orifice of said valve from opening inwardly when the ambient external pressure on the valve exterior side exceeds the pressure on the valve interior side.

9. The dispensing system in accordance with claim 8 in which said discharge conduit includes a tapered exterior portion; and said cap valve structure outer skirt has a tapered interior wall for engaging said conduit tapered exterior portion.

10. The dispensing system in accordance with claim 8 in which said valve is recessed below said annular end cap portion when said valve is closed.

11. The dispensing system in accordance with claim 8 in which said discharge conduit inlet end is adapted for connecting to a flexible tube.

12. The dispensing system in accordance with claim 8 in which said restraint structure is snap-fit into said discharge conduit.

* * * * *